US012662171B2

(12) United States Patent
Hoeck et al.

(10) Patent No.: US 12,662,171 B2
(45) Date of Patent: Jun. 23, 2026

(54) CABLEWAY HAVING A LIMITING DEVICE

(71) Applicant: Innova Patent GmbH, Wolfurt (AT)

(72) Inventors: Jari Hoeck, Hard (AT); Gerd Dür, Bildstein (AT)

(73) Assignee: INNOVA PATENT GMBH, Wolfurt (AT)

( * ) Notice: Subject to any disclaimer, the term of this patent is extended or adjusted under 35 U.S.C. 154(b) by 467 days.

(21) Appl. No.: 18/344,193

(22) Filed: Jun. 29, 2023

(65) Prior Publication Data

US 2024/0001968 A1 Jan. 4, 2024

(30) Foreign Application Priority Data

Jun. 30, 2022 (AT) ..... A 50480/2022

(51) Int. Cl.
*B61B 12/04* (2006.01)
*B61B 12/02* (2006.01)

(52) U.S. Cl.
CPC ..... *B61B 12/04* (2013.01); *B61B 12/02* (2013.01)

(58) Field of Classification Search
CPC ..... B61B 1/04; B61B 12/02
See application file for complete search history.

(56) References Cited

U.S. PATENT DOCUMENTS 4,327,646 A * 5/1982 Nakata ..... B61B 12/04 104/93
4,369,714 A * 1/1983 Morita ..... B61B 12/04 104/93
4,637,646 A 1/1987 Ortwein et al.
5,460,099 A * 10/1995 Matsuhisa ..... F16F 15/022 104/115

(Continued)

FOREIGN PATENT DOCUMENTS

CH 716223 A2 11/2020
CN 101633360 A 1/2010

(Continued)

OTHER PUBLICATIONS

European Search Report dated Nov. 23, 2023 for Application No. 23182036.6.

(Continued)

*Primary Examiner* — Jess Whittington
(74) *Attorney, Agent, or Firm* — Husch Blackwell LLP

(57) ABSTRACT

A cableway having at least one cableway station and having at least one cableway vehicle movable between cableway stations with a hauling cable, wherein a control unit is provided for controlling the cableway, the cableway including a limiting device configured adjacent an entry region of the cableway station and operable to limit a lateral pendulum movement of the cableway vehicle as the cableway vehicle enters the cableway station; at least one movable detection element adjacent the cableway station; a detection unit (Continued)

associated with the at least one movable detection element and configured to detect a measured variable associated with a deflection of the detection element and transmit a corresponding signal to the control unit, and wherein the control unit is configured to receive the corresponding signal and control the cableway as a function of the detected measured variable. An associated method for operating a cableway is also described.

20 Claims, 3 Drawing Sheets

(56) References Cited

U.S. PATENT DOCUMENTS

| | | | | |
|---|---|---|---|---|
| 5,778,797 | A * | 7/1998 | Mutaguchi | F16F 7/10 188/380 |
| 6,035,787 | A * | 3/2000 | Mutaguchi | F16F 7/10 188/380 |
| 7,802,523 | B2 * | 9/2010 | Moritzhuber | B61B 12/06 104/178 |
| 2003/0056708 | A1 * | 3/2003 | Vollmerhausen | B63B 27/19 114/258 |
| 2006/0060107 | A1 * | 3/2006 | Schertler | B61B 12/04 105/148 |
| 2011/0083577 | A1 * | 4/2011 | Tilley | B66C 21/02 104/96 |
| 2020/0156665 | A1 * | 5/2020 | Hofmayr | B61B 12/002 |
| 2023/0211811 | A1 * | 7/2023 | Monteiro | B61B 7/06 104/137 |
| 2023/0303129 | A1 * | 9/2023 | Jaegle | B61B 7/06 |

FOREIGN PATENT DOCUMENTS

| | | | |
|---|---|---|---|
| CN | 210437176 | U | 5/2020 |
| DE | 300399 | | 8/1980 |
| EP | 0218306 | | 4/1987 |
| EP | 2147843 | | 1/2010 |
| JP | H0257923 | A | 2/1990 |
| JP | H02065667 | U | 5/1990 |
| JP | 4598634 | B2 | 12/2010 |
| JP | 2020-090243 | A | 6/2020 |

OTHER PUBLICATIONS

Machine Translation for JP4598634B2.
Machine Translation for CN210437176U.
Chinese Office Action issued on Oct. 18, 2025 in corresponding Chinese Application No. 202310754158.7.
Search Report dated Feb. 28, 2023 for Austrian Patent Application No. A50480-2022.

* cited by examiner

CABLEWAY HAVING A LIMITING DEVICE

CROSS REFERENCE

This application claims priority to Austrian Patent Application No. A50480/2022 filed on 30 Jun. 2022, the disclosure of which is incorporated herein by reference in its entirety.

TECHNICAL FIELD

The present disclosure relates to a cableway having a number of cableway stations and a number of cableway vehicles that are movable between cableway stations by means of a hauling cable, wherein a control unit is provided for controlling the cableway and wherein a limiting device for limiting a lateral pendulum movement of a cableway vehicle entering the cableway station is provided in an entry region of at least one cableway station. The present disclosure also relates to a method for operating a cableway having a number of cableway stations and a number of cableway vehicles that are movable between the cableway stations by means of a hauling cable, wherein the cableway is controlled with a control unit and wherein a cableway vehicle is moved with a lateral pendulum movement into an entry region E of a cableway station in which a limiting device for limiting the lateral pendulum movement is provided.

BACKGROUND

It is well known that in unfavorable wind conditions, the cableway vehicles of a cableway can be excited into pendulum movements. Depending on the wind direction, wind speed and wind variation over time, a pendulum movement of the cableway vehicles in the direction of movement as well as a lateral pendulum movement transverse to the direction of movement can be generated. While pendulum movements in the direction of movement can generally be reduced by means of operational measures, for example by adjusting the conveying speed, lateral pendulum movement is not easily influenced. While a lateral pendulum movement on a free path is unpleasant for passengers, the risk of damage or injuries is relatively low. In particular, however, lateral pendulum movement can pose a significant hazard in the entry region of cableway stations if they exceed a certain deflection. In the worst case, this can lead to a collision of the cableway vehicle with components of the cableway station or to the hauling cable coming out of the cable guide. In order to avoid damage to the cableway and the risk of injury to passengers, the cableway is therefore generally stopped when the lateral pendulum movement exceeds a certain deflection.

It is therefore an object of the present disclosure to increase safety when a cableway vehicle enters a cableway station of a cableway in the simplest possible manner.

SUMMARY

Embodiments of the present disclosure include a cableway having at least one cableway station and having at least one cableway vehicle movable between cableway stations with a hauling cable, wherein a control unit is provided for controlling the cableway, the cableway including a limiting device configured adjacent an entry region of the cableway station and operable to limit a lateral pendulum movement of the cableway vehicle as the cableway vehicle enters the cableway station; at least one movable detection element adjacent the cableway station; a detection unit associated with the at least one movable detection element and configured to detect a measured variable associated with a deflection of the detection element and transmit a corresponding signal to the control unit, and wherein the control unit is configured to receive the corresponding signal and control the cableway as a function of the detected measured variable.

For example, the detection unit can have one of the following sensors for detecting the measured variable: distance sensor, position sensor, speed sensor, acceleration sensor, rotational angle sensor, rotational speed sensor, rotational acceleration sensor, structure-borne noise sensor, force sensor, strain gauge, pressure sensor, electrical switch. As a result, a variable representative of the lateral pendulum movement of the entering cableway vehicle can be detected via the deflection of the detection element. The measured variable can be used to control one or more safety-relevant functions of the cableway.

An evaluation unit is preferably provided that is designed to determine a parameter of the lateral pendulum movement of the entering cableway vehicle from the detected measured variable or from a variable derived therefrom and at least one operating variable of the cableway, and the control unit is designed to control the cableway as a function of the determined parameter. For example, the parameter can be at least one of the following variables: distance, position, speed, acceleration, angle, frequency and/or in that the operating variable is a conveying speed. As a result, a more complex evaluation logic can be used than in the case of the direct use of the measured variable. For example, a deflection angle of the lateral pendulum movement of the cableway vehicle can be determined from a measured position of the detection element and from a conveying speed of the cableway vehicle or the hauling cable. If the deflection angle, for example, exceeds a predetermined value, the control unit can initiate appropriate actions, for example stopping the cableway.

Preferably, the movable detection element is designed to carry out a translatory movement and/or a rotational movement. As a result, flexible structural configuration and arrangement in the cableway station is possible. While a rotationally movable detection element generally has a free end that faces away from the cableway station in the direction of movement, a translationally movable detection element may also be, for example, a central portion of the limiting device that does not necessarily have to have a free end.

The limiting device preferably has two opposite limiting elements that converge in the direction of movement, wherein at least one of the limiting elements has the at least one detection element. For example, depending on which component of the cableway vehicle the limiting device comes into contact with during the lateral pendulum movement, the limiting elements can be spaced apart in the vertical direction, i.e., substantially vertically, or in the transverse direction, i.e., substantially horizontally. It can be advantageous if both limiting elements have a movable detection element and a detection device in order to be able to detect the pendulum movement in both directions. For example, a part of a limiting element can form the detection element or the entire limiting element can form an entire limiting element.

According to an advantageous embodiment, the number of cableway vehicles in each case has a conveying body for receiving a number of persons, which is connected to a lower portion of a hanger, wherein an upper portion of the hanger is connected to a hanger carrier, and the limiting device is arranged in the at least one cableway station in such a way that the at least one detection element can be deflected in the case of a lateral pendulum movement of an entering cableway vehicle by an outer side of the conveying body or by the hanger or by a contact element arranged on the underside of the conveying body or by a component of the hanger carrier of the cableway vehicle. As a result, the limiting device can be adapted very flexibly to contact a desired component of the cableway vehicle.

Preferably, a guide rail is provided in the at least one cableway station, and a cable clamp for, preferably releasable, coupling of the cableway vehicle to the hauling cable, at least one guide roller, by means of which the cableway vehicle is movable in a state decoupled from the hauling cable along the guide rail, and a support roller are provided on the hanger carrier, and the limiting device is arranged in the at least one cableway station in such a way that the detection element can be deflected by a pendulum movement of the support roller, preferably in the vertical direction. As a result, the limiting device can advantageously be designed to be relatively compact and be arranged in an upper region of the cableway station.

The limiting device can also have a guide profile that tapers in the direction of movement and forms the detection element, wherein the guide profile has two vertically opposite legs that are connected by a central connecting portion, wherein the support roller of a cableway vehicle located in the region of the limiting device is received between the legs. As a result, an embodiment can be created that is simple and requires little installation effort. For example, a U-profile can be used that is arranged so as to be vertically movable. The U-profile can be connected to a support guide rail provided in the cableway station, in which the support roller is guided during movement within the cableway station to stabilize the cableway vehicle. In the case of a lateral pendulum movement of the cableway vehicle, the support roller carries out a substantially vertical pendulum movement, which deflects the entire guide profile when it comes into contact with one of the legs. Thus, only one detection unit is required.

It is advantageous if a spring device is provided that is designed to cushion the deflection of the detection element, wherein the spring device preferably has at least one of the following springs: coil spring, turning spring, torsion spring, leaf spring, gas spring, air spring, rubber spring. Alternatively or additionally, a damping device can be provided that is designed to dampen the deflection of the detection element, wherein the damping device preferably has at least one of the following dampers: hydraulic damper, pneumatic damper, friction damper. By means of the spring device, the detection element can be quickly reset to its neutral position. On the other hand, the damping device can dampen the pendulum movement of the vehicle, similar to a shock absorber.

Preferably, a drive device for driving the number of cableway vehicles is provided in the cableway, and the control unit is designed to use the detected measured variable or a variable derived therefrom and/or the determined parameter or a variable derived therefrom to control the drive device. For example, a first threshold value can be defined and the control unit can stop the drive device or reduce a conveying speed of the cableway vehicles if the detected measured variable and/or the determined parameter and/or the derived variable exceeds the first threshold value. As a result, the cableway can be stopped, for example, when the measured variable, for example a position of the detection element, exceeds the first threshold value. If an evaluation unit is provided, the cableway can be stopped in an analogous manner, for example, if the parameter, for example a deflection angle of the cableway vehicle about the hauling cable, exceeds the first threshold value. Alternatively or additionally, a derived variable of the measured variable or of the parameter, for example a time derivative, could also be used. Of course, multiple different first threshold values could also be specified and the control unit could, for example, first reduce the conveying speed when the lower threshold value is exceeded and only stop the drive device when the higher threshold value is exceeded.

An alarm device is preferably provided in the cableway, and the control unit is designed to use the detected measured variable or a variable derived therefrom and/or the determined parameter or a variable derived therefrom to control the alarm unit to generate a, preferably optical, acoustic or electronic alarm signal. For example, a second threshold value can be defined and the alarm unit can generate the alarm signal if the detected measured variable and/or the determined parameter and/or the derived variable exceeds the second threshold value. As a result, the passengers and the cableway personnel can be alerted, for example by a siren, strobe light or electronic message sent to an emergency call center or a control room of another cableway station. In turn, multiple different second threshold values could also be specified, wherein, for example, first a first alarm signal, for example an electronic message, is generated when the lower second threshold value is exceeded, and a second alarm signal, for example a siren, is generated when the higher threshold value is exceeded.

The object of the present disclosure is also achieved by the method mentioned at the outset in that the cableway vehicle contacts and deflects a movable detection element of the limiting device, in that a measurement variable of the deflection of the detection element is detected and in that the detected measured variable is used by the control unit to control the cableway.

These objects are merely illustrative of the features and advantages associated with the present disclosure and should not be deemed as limiting in any manner. These and other objects, features and advantages of the present disclosure will become apparent from the following detailed description when taken in conjunction with the referenced drawings.

BRIEF DESCRIPTION OF THE DRAWINGS

Reference is now made more particularly to the drawings, which illustrate the best presently known mode of carrying out the disclosure and wherein similar reference characters indicate the same parts throughout all views.

DETAILED DESCRIPTION

Figure 1:
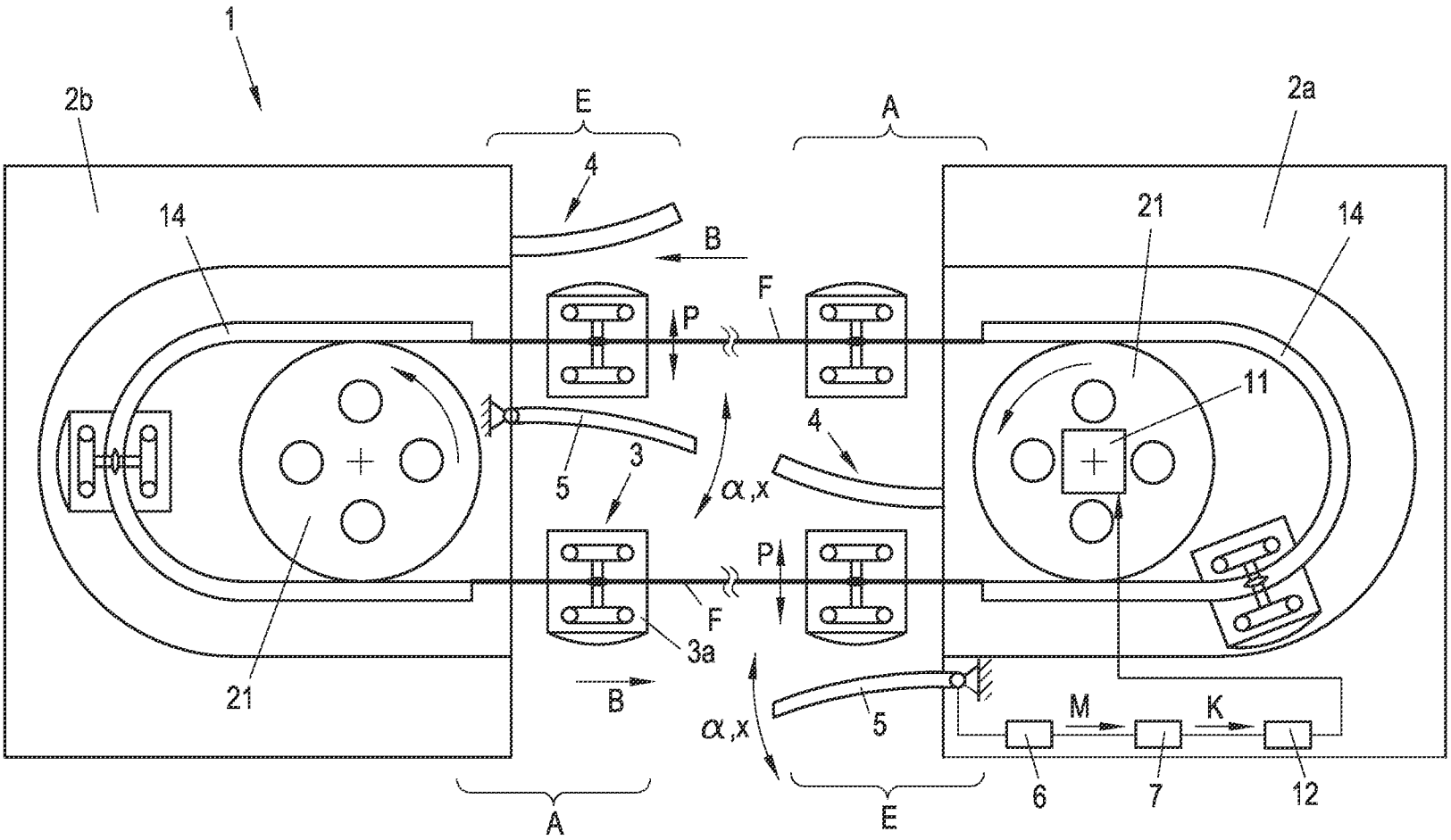
FIG. 1 is a schematic from above of an embodiment of a cableway according to the present disclosure.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. The following definitions and non-limiting guidelines must be considered in reviewing the description of the technology set forth herein.

The headings (such as "Background" and "Summary") and sub-headings used herein are intended only for general organization of topics within the present disclosure and are not intended to limit the disclosure of the technology or any aspect thereof. In particular, subject matter disclosed in the "Introduction" may include novel technology and may not constitute a recitation of prior art. Subject matter disclosed in the "Summary" is not an exhaustive or complete disclosure of the entire scope of the technology or any embodiments thereof. Classification or discussion of a material within a section of this specification as having a particular utility is made for convenience, and no inference should be drawn that the material must necessarily or solely function in accordance with its classification herein when it is used in any given composition.

The citation of references herein does not constitute an admission that those references are prior art or have any relevance to the patentability of the technology disclosed herein. All references cited in the "Detailed Description" section of this specification are hereby incorporated by reference in their entirety.

The description and specific examples, while indicating embodiments of the technology, are intended for purposes of illustration only and are not intended to limit the scope of the technology. Moreover, recitation of multiple embodiments having stated features is not intended to exclude other embodiments having additional features, or other embodiments incorporating different combinations of the stated features. Specific examples are provided for illustrative purposes of how to make and use the apparatus and systems of this technology and, unless explicitly stated otherwise, are not intended to be a representation that given embodiments of this technology have, or have not, been made or tested.

"A" and "an" as used herein indicate "at least one" of the item is present; a plurality of such items may be present, when possible. "About" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. In addition, disclosure of ranges includes disclosure of all distinct values and further divided ranges within the entire range.

FIG. 1 shows an exemplary cableway 1. The cableway 1 has a number of cableway stations 2*a*, 2*b* and a number of cableway vehicles 3 that can be moved between the cableway stations 2*a*, 2*b* with a hauling cable F. The illustrated cableway 1 is designed as a continuous cableway in which the hauling cable F is deflected in an endless loop around cable pulleys 21 that are arranged in the cableway stations 2*a*, 2*b*. The cableway vehicles 3 each have a cable clamp (not shown in FIG. 1) with which the cableway vehicles 3 can be detachably and non-positively coupled to the hauling cable F. The cableway 1 also has a drive device 11 for driving the cableway vehicles 3. In this case, the drive device 11 is designed to drive at least one of the pulleys 21 in order to exert a driving force on the hauling cable F, by means of which the cableway vehicles 3 are driven.

In an entry region E of the cableway stations 2*a*, 2*b*, the cableway vehicles 3 can be decoupled from the hauling cable F by actuating the cable clamp, then decelerated and moved at a reduced speed along a guide rail 14 to an exit area A. In the exit area A, the cableway vehicles 3 can be accelerated again to the speed of the hauling cable F and can be coupled to the hauling cable F by actuating the cable clamp again. In order to drive the cableway vehicles 3 in the decoupled state, the drive device 11 can also have a suitable auxiliary drive (not shown). The auxiliary drive can have, for example, a plurality of driven friction wheels arranged one behind the other along the guide rail 14, which interact with a friction lining of the cableway vehicles 3 to drive the cableway vehicles 3.

In the example shown, a first cableway station 2*a* and a second cableway station 2*b* are shown, which are designed as terminal stations. Of course, one or more further cableway stations (not shown) could also be provided between the terminal stations 2*a*, 2*b*, which further cableway stations are designed as intermediate stations and which can be traversed by the cableway vehicles in a respective direction of travel without the cableway vehicles 3 being turned around.

Furthermore, a control unit 12 for controlling functions of the cableway 1 is provided in the cableway 1. The control unit 12 has suitable hardware and/or software and is arranged in the first cableway station 2*a* in the example shown. Of course, this is only exemplary and the control unit 12 could also be arranged at another suitable location of the cableway 1. Of course, the control unit 12 may optionally also have multiple control units (not shown) that communicate with each other in a suitable manner. The control unit 12 is in particular designed to control the drive device 11 in order to control the conveying speed of the cableway vehicles 3. Of course, however, further functions of the cableway 1 that are not relevant to the present disclosure can also be controlled by the control unit 12. The basic structure and the function of a cableway 1 are known, which is why no more detailed description is given at this point.

A limiting device 4 is provided in each case in the entry regions E of the cableway stations 2*a*, 2*b* in order to limit the lateral pendulum movement P of a cableway vehicle 3 entering the respective cableway station 2*a*, 2*b*. In this case, the limiting devices 4 each have a movable detection element 5 and a detection unit 6 for detecting a measured variable M of a deflection of the detection element 5 is provided. Depending on the structural design of the detection element 5, the deflection can be, for example, a translatory deflection X or a rotational deflection $\alpha$. The control unit 12 is designed to control the cableway 1 as a function of the detected measured variable M. As a result, the control unit 12 can control the drive device 11, for example, in order to stop the drive of the cableway vehicles 3 or to reduce a conveying speed when the measured variable M reaches or exceeds a defined value.

In a preferred embodiment of the present disclosure, an evaluation unit 7 can also be provided, which is designed to determine a parameter K of the lateral pendulum movement P of the entering cableway vehicle 3 from the detected measured variable M or from a variable derived therefrom, for example a time derivative, and at least one operating variable of the cableway 1. In this case, the control unit 12 is preferably designed to control the cableway 1, in particular the drive device 11, as a function of the determined parameter K. The parameter K can be, for example, a path, a position, a speed, an acceleration, an angle or a frequency of the lateral pendulum movement P of the entering cableway vehicle 3. The operating variable can be, for example, the current conveying speed or a variable representative of the conveying speed, for example an electrical variable such as a current or a voltage. As a result, a more complex evaluation logic is possible as compared to the use of the measured variable M.

Figure 3:
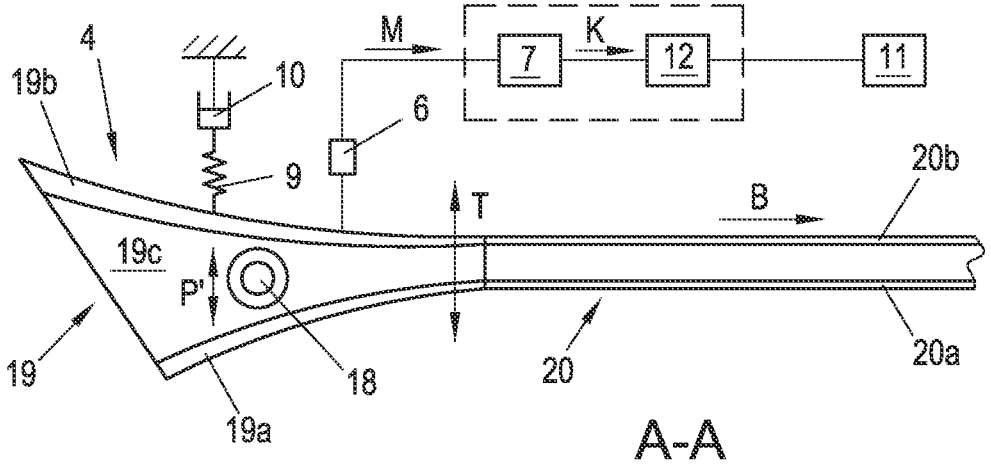
FIG. 3 is a schematic view from behind of a cableway vehicle in an entry region of a cableway station according to an embodiment of the present disclosure.
Figure 3:
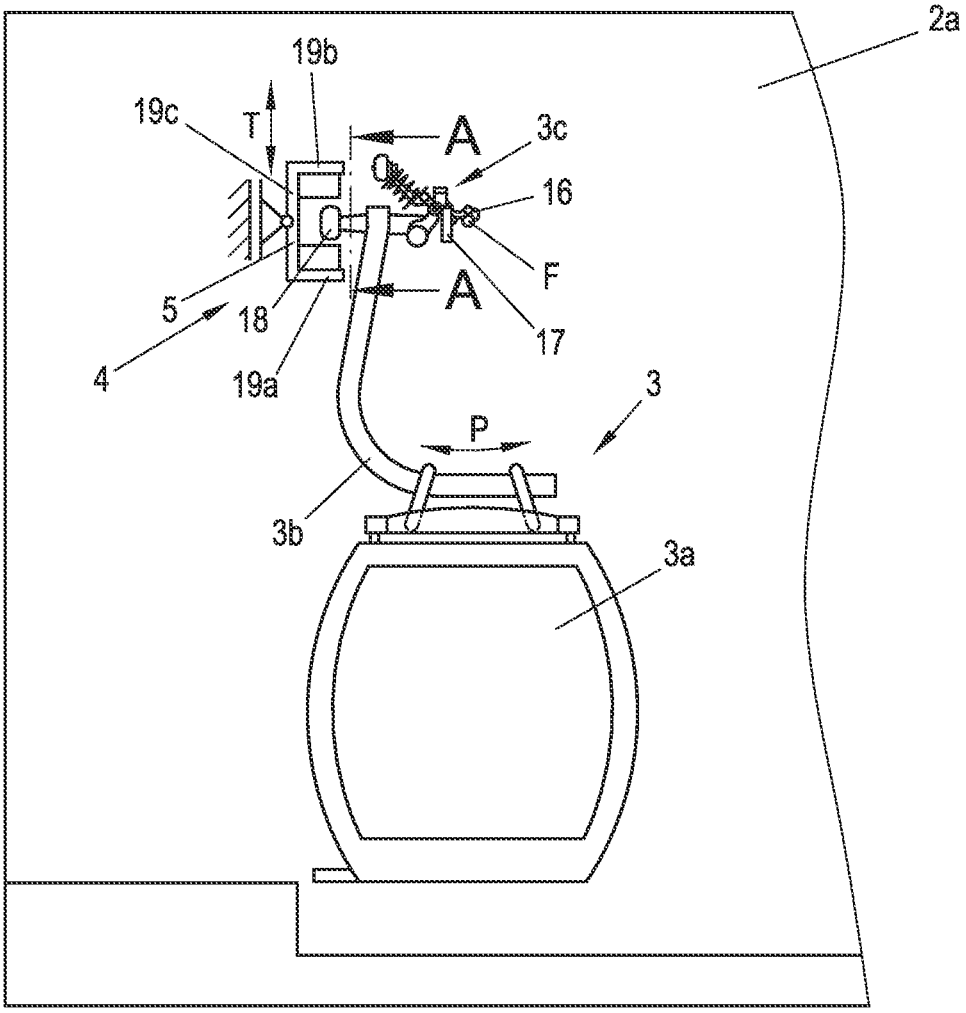

The cableway vehicles 3 each have a conveying body 3*a* for receiving a number of persons, which is connected to a lower portion of a hanger 3*b*, and an upper portion of the hanger 3*b* is connected to a hanger carrier 3*c* (see also FIG. 3). Preferably, the hanger 3*b* is rotatably connected to the hanger carrier 3*c* via a joint in order to allow a pendulum movement in the direction of movement B, i.e., forward and backward. Depending on the design of the cableway 1, the conveying body 3*a* can be designed in different ways. In the case of a pure cabin cableway, for example, each of the cableway vehicles 3 has a cabin as a conveying body 3*a* for receiving persons, as shown by way of example in FIG. 1. However, the cableway 1 could also be designed as a chairlift, wherein each of the cableway vehicles 3 has a chair as a conveying body 3*a* for receiving persons. A combination of cabin cableway and chairlift, referred to as a combined lift, is also possible in which a certain number of cableway vehicles 3 having cabins and a certain number of cableway vehicles having chairs are arranged alternately on the hauling cable F. For example, for every three chairs one cabin can follow, etc.

The limiting device 4 is preferably arranged in the cableway station 2*a* in such a way that the at least one detection element 5 is contacted in the case of a lateral pendulum movement P of an entering cableway vehicle 3 by an outer side of the conveying body 3*a* or by the hanger 3*b* or by a contact element 15 arranged on the underside of the conveying body 3*a* or by a component of the hanger carrier 3*c*. The contact element 15 is only indicated in dashed lines in FIG. 2 and can, for example, have a suitable guide rail or a guide pin that projects downward from the conveying body 3*a*. Depending on the desired type of contact, a suitable arrangement of the limiting device 4 in the cableway station 2*a* can be provided. Details of preferred embodiments of the present disclosure are described in more detail below with reference to FIG. 2 and FIG. 3.

Figure 2:
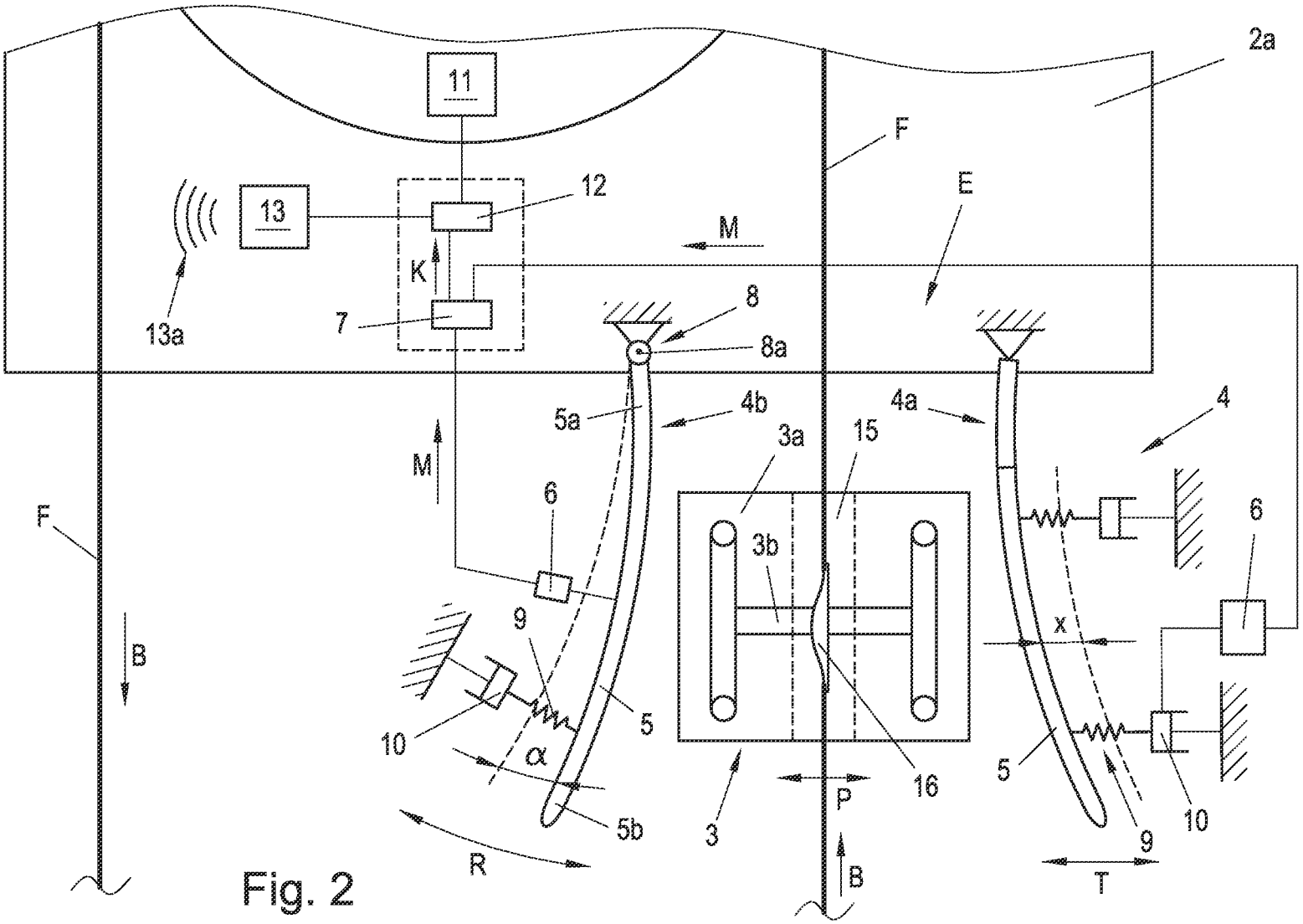
FIG. 2 is a schematic view from above of a cableway vehicle in an entry region of a cableway station according to an embodiment of the present disclosure.

In FIG. 2, the entry region E of the first cableway station 2*a* from FIG. 1 is shown at a point in time at which a cableway vehicle 3 that is entering the cableway station 2*a* is located in the region of the limiting device 4. The cableway vehicle 3 performs a lateral pendulum movement P transverse to the direction of movement B, which can be caused, for example, by a gust of wind. In this case, the limiting device 4 has two limiting elements 4*a*, 4*b* that are arranged opposite each other transversely to the direction of movement B and converge in the direction of movement B. In the example shown, both limiting elements 4*a*, 4*b* have a detection element and a detection unit 6. In principle, however, it would be sufficient if only one of the limiting elements 4*a*, 4*b* had a movable detection element 5.

The movable detection element 5 can carry out a translatory movement T, for example, as shown by the limiting element 4*a* shown on the right. For this purpose, for example, the front portion of the limiting element 4*a*, which has a free end, can form the detection element 5 and be mounted translatory moveable in a suitable manner in the cableway station 2*a*. Alternatively, however, the detection element 5 could also be formed by a central portion of the limiting element 4*a* (not shown).

In this case, the detection element 5 can carry out a translatory movement T when the cableway vehicle 3 carries out a lateral pendulum movement P around the hauling cable F as an axis of rotation with a sufficiently large amplitude. A variable of the translatory deflection X of the detection element 5 can be detected as measured variable M, for example a position or a path, etc. The type of measured variable M depends on the type of the detection unit 6 used. For example, the detection unit 6 can have one of the following sensors for detecting the measured variable M: distance sensor, position sensor, speed sensor, acceleration sensor, structure-borne noise sensor, force sensor, strain gauge, pressure sensor, electrical switch. The use of multiple sensors is also possible, of course, as is the combination of multiple sensors.

Alternatively or additionally, the detection element 5 can also be designed to carry out a rotational movement R, as is indicated by the limiting element 4*b* shown on the left in FIG. 2. For this purpose, for example, the entire limiting element 4*a* can form the detection element 5, as shown by way of example. Of course, for example, only a front portion of the limiting element 4*a*, which has a free end 5*b* facing away from the cableway station 2*a* could also form the detection element 5. In this case, the limiting element 4*a* is mounted rotatably in the cableway station 2*a* around a joint 8 having a substantially vertical axis of rotation 8*a*. The limiting element 4*a* can thus execute a rotational movement R about the axis of rotation 8*a* when the cableway vehicle 3 performs a lateral pendulum movement P with a sufficiently large amplitude.

In this case, a variable of the rotational deflection $\alpha$ of the detection element 5 can be detected as measured variable M, for example a position or a path or an angle, etc. The type of measured variable M in turn depends on the type of the detection unit 6 used. For example, the detection unit 6 can have one of the following sensors for detecting the measured variable M: distance sensor, position sensor, speed sensor, acceleration sensor, structure-borne noise sensor, force sensor, strain gauge, pressure sensor, electrical switch, rotational angle sensor, rotational speed sensor or rotational acceleration sensor. The use of multiple sensors is also possible, of course, as is the combination of multiple sensors.

In the embodiment shown, an evaluation unit 7 is also provided, which is connected to the detection units 6 via a suitable wireless or wired communication connection, for example a sensor line. The evaluation unit 7 is designed to determine a parameter K of the lateral pendulum movement P of the entering cableway vehicle 3 from the respectively detected measured variable M or from a variable derived therefrom and at least one operating variable of the cableway 1. The evaluation unit 7 is connected to the control unit 12 via a suitable wireless or wired communication connection, for example an electrical line, in order to transmit the parameter K to the control unit 12. Advantageously, the evaluation unit 7 can also be integrated into the control unit 12, for example as a suitable program of a software, as indicated by the dashed border in FIG. 2. The control unit 12 is designed to control the cableway 1 as a function of the determined parameter K.

According to an advantageous embodiment, the detection unit 6 can have, for example, a suitable position sensor for detecting a position of the detection element 5 (as the measured variable M), and a conveying speed of the cableway vehicles 3 (which corresponds to the speed of the hauling cable F in the coupled state) is used as the operating variable. The conveying speed can be known or a suitable sensor (not shown), for example an induction transmitter, can also be provided for detecting the conveying speed, which can be arranged at a suitable location of the cableway 1 and which communicates with the control unit 12. On the basis of the position (as the measured variable M) and on the basis of the conveying speed (as the operating variable), the evaluation unit 7 can then determine an angle of the lateral pendulum movement P of the cableway vehicle 3 about the hauling cable F as an axis of rotation.

For example, the control unit 12 can directly use the measured variable M detected by the detection unit 6, for example the position of the detection element 5, or a variable derived therefrom, for example a distance or speed, to control the drive device 11. In this case, an evaluation unit 7 can also be dispensed with. However, the control unit 12 can also use the parameter K determined by the evaluation unit 7, for example the deflection angle of the pendulum movement P, or a variable derived therefrom, for example an angular velocity, to control the drive device 11. For example, a first threshold value can be defined or definable in the control unit 12, and the control unit 12 can stop the drive device 11 or reduce a conveying speed of the cableway vehicles 3 if the detected measured variable M and/or the determined parameter K and/or the respectively derived variable exceeds the first threshold value.

Preferably, the cableway 1 is also provided with an alarm device 13, and the control unit 12 is designed to use the detected measured variable M (or a variable derived therefrom) and/or the determined parameter K (or a variable derived therefrom) to control the alarm unit 13 to generate a, preferably optical, acoustic or electronic, alarm signal 13*a*. For example, a second threshold value can be defined or definable in the control unit 12, and the alarm signal 13*a* is generated if the detected measured variable M and/or the determined parameter K and/or the derived variable exceeds the second threshold value.

In a simple embodiment without an evaluation unit 7, for example, a second threshold value can be specified that is smaller than the first threshold value. In this case, an alarm signal 13*a* is generated first when the second (lower) threshold value is exceeded, and the drive device 11 is stopped (or the conveying speed is reduced) only when the first (higher) threshold value is exceeded. If an evaluation unit 7 is provided, this procedure can also take place in an analogous manner for the determined parameter K, either instead of or possibly in addition to the measured variable.

Advantageously, a spring device 9 can also be provided in order to cushion the deflection α, X of the respective detection element 5. The spring device can have, for example, a coil spring, turning spring, torsion spring, leaf spring, gas spring, air spring or rubber spring. Alternatively or additionally, a damping device 10 can also be provided in order to dampen the deflection α, X of the respective detection element 5. The damping device 10 can have, for example, a hydraulic damper, a pneumatic damper or a friction damper. As is indicated schematically in the example according to FIG. 2, one or more combined suspension/damping units can also be provided. As is indicated on the right in FIG. 2, the detection unit 6 does not necessarily have to detect the measured variable M directly at the detection element 5, but instead the measured variable M could also be measured at a component connected to the detection element 5, for example the damping device 10.

Another advantageous embodiment of the present disclosure is explained below with reference to FIG. 3. FIG. 3 shows a cableway vehicle 3 having a cabin as a conveyor body 3*a* in the entry area E of a cableway station 2*a* in a view from the rear in the direction of movement B. The conveyor body 3*a* is connected to a hanger carrier 3*c* via hanger 3*b*. As already mentioned, the hanger 3*b* is preferably connected to the hanger carrier 3*c* by an axis of rotation extending transversely to the direction of movement B and substantially horizontally in order to allow a pendulum movement in the direction of movement (forward and backward). The cable clamp 16 and at least one guide roller 17 and a support roller 18 are provided on the hanger carrier 3*c*. The guide roller(s) 17 are used to move the cableway vehicle 3 within the cableway station 2 along the guide rail 14 in a state decoupled from the hauling cable F. Of course, multiple guide rollers 17 can also be arranged on the hanger carrier 3*c* so as to be rotatably mounted one behind the other in the direction of movement.

The support roller 18 serves to stabilize the cableway vehicle 3 during the movement along the guide rail 14, so that a lateral pendulum movement during the movement within the cableway station 2 is prevented or at least reduced as much as possible. A support guide rail 20, which runs substantially parallel to the guide rail 14, can be provided for this purpose. During the movement of the cableway vehicle 3, the support roller 18 is guided along the supporting guide rail 20. In this case, the limiting device 4 is arranged in an upper region of the cableway station 2*a* in such a way that the detection element 5 can be deflected in a substantially vertical direction during a lateral pendulum movement P of the cableway vehicle 3 by means of a pendulum movement P' of the support roller 18.

FIG. 3 shows a section A-A that shows the limiting device 4 and the supporting guide rail 20 in a side view in the direction of the arrow. In this case, the limiting device 4 has a guide profile 19 that tapers in the direction of movement B and has two legs 19*a*, 19*b* opposite each other in the vertical direction. The support guide rail 20 adjoins the guide profile 19 in the direction of movement B and likewise has two legs 20*a*, 20*b* opposite each other. The support roller 18 of the cableway vehicle 3 entering the cableway station 2 is thus initially received between the legs 19*a*, 19*b* of the guide profile 19 in the region of the limiting device 4. During the further movement, the support roller 18 is received in the region of the support guide rail 20 between the legs 20*a*, 20*b* of the support guide rail 20.

In the example shown, the guide profile 19 is designed as a rigid U-profile. The legs 19*a*, 19*b* are thus connected by a connecting portion 19*c*. This means that, in the case of a vertical pendulum movement P' of the support roller 18, the legs 19*a*, 19*b* can only be deflected together by the support roller 18. The entire guide profile 19 thus functions as a movable detection element 5. In the example shown, the guide profile 19 is designed to carry out a vertical translatory movement T, as is symbolized by the double arrow. This is advantageous because the support guide rail 20 can thereby be substantially directly adjacent to the guide profile 19. Alternatively, of course, a rotational movement of the guide profile 19 about a substantially horizontal axis of rotation (not shown) would also be conceivable, which is preferably located in the region of the tapered portion of the guide profile 19 and which is substantially normal to the drawing plane of the sectional view.

In turn, a detection unit 6 for detecting a measured variable M of the deflection of the guide profile 19 and an evaluation unit 7 communicating therewith are provided for determining a parameter K of the lateral pendulum movement P of the cableway vehicle 3. The evaluation unit 7 is connected to the control unit 12, which controls the drive device 11 of the cableway 1. Since the entire guide rail 19 is always deflected in this case, only one detection unit 6 is required in principle. Of course, two or more detection units 6 could also be provided, for example one detection unit 6 per direction of deflection.

Of course, the embodiment as a rigid U-profile is only exemplary and two separate, mutually independent, limiting elements 4*a*, 4*b* could also be provided, spaced apart in the vertical direction. In this case, analogously to the example according to FIG. 2, at least one of the limiting elements 4*a*, 4*b* can have the detection element 5 (or also both). While the limiting elements 4*a*, 4*b* are spaced apart transversely to the direction of movement B, i.e., substantially horizontally, and are designed to be contacted by the conveying body 3*a*, the limiting elements 4*a*, 4*b* in FIG. 3 would be spaced apart in the vertical direction, i.e., substantially vertically, and designed to be contacted by the support roller 18. Furthermore, the same applies to this embodiment as for the variant according to FIG. 2, for which reason further details are dispensed with at this point.

Finally, it is pointed out that the present disclosure is not limited to the illustrated continuous cabin cableway, but that other continuous cableways are also encompassed by the present disclosure, in particular the aforementioned chairlift or combination lift. In addition, the present disclosure also comprises multi-cable continuous cableways in which the hauling cable functions as a traction cable and at least one support cable is additionally provided on which the cableway vehicle rolls by means of a running gear. Likewise, reversible cableways are also encompassed by the present disclosure.

Exemplary embodiments of the disclosure have been described above to explain the principles of the present disclosure and its practical application to thereby enable others skilled in the art to utilize the present disclosure. However, as various modifications could be made in the constructions and methods herein described and illustrated without departing from the scope of the present disclosure, it is intended that all matter contained in the foregoing description or shown in the accompanying drawings, including all materials expressly incorporated by reference herein, shall be interpreted as illustrative rather than limiting. Thus, the breadth and scope of the present disclosure should not be limited by the above-described exemplary embodiment but should be defined only in accordance with the following claims appended hereto and their equivalents.

What is claimed is:

1. A cableway having at least one cableway station and having at least one cableway vehicle movable between cableway stations with a hauling cable, wherein a control unit is provided for controlling the cableway, the cableway comprising:

a limiting device located adjacent to an entry region of the cableway station where the cableway vehicle enters the cableway station, wherein the limiting device is operable to limit a lateral pendulum movement of the cableway vehicle as the cableway vehicle enters the cableway station;

at least one movable detection element located adjacent to the entry region of the cableway station;

a detection unit associated with the at least one movable detection element, wherein the detection unit comprises at least one sensor for measuring a variable associated with a deflection of the detection element and transmit a corresponding signal to the control unit, and wherein the control unit comprises a communication connection with the detection unit, such that the control unit receives the corresponding signal and controls the cableway as a function of the detected measured variable.

2. The cableway according to claim 1, further comprising an evaluation unit having a communication connection with the control unit, such that the evaluation unit determines a lateral pendulum movement parameter of the cableway vehicle as a function of at least one of the detected measured variable and a variable derived from the detected measured variable and at least one operating variable of the cableway, and wherein the control unit is further configured to control the cableway as a function of at least the determined lateral pendulum movement parameter.

3. The cableway according to claim 2, wherein the lateral pendulum parameter comprises at least one of distance, position, speed, acceleration, angle, frequency and wherein the operating variable comprises conveying speed.

4. The cableway according to claim 1, wherein the at least one movable detection element is configured to carry out at least one of a translatory movement and a rotational movement.

5. The cableway according to claim 1, wherein the limiting device comprises two mutually opposite limiting elements that converge in a direction of movement of the hauling cable and wherein at least one of the two mutually opposite limiting elements comprises the at least one movable detection element.

6. The cableway according to claim 1, wherein the cableway vehicle comprises:

a conveying body for receiving a number of persons;

a hanger having a lower portion connected with the conveying body, an upper portion connected with the lower portion, and a hanger carrier connected with the upper portion, and wherein the limiting device is configured in the cableway station such that the at least one movable detection element is deflected by at least one of the conveying body, a component of the hanger, and a contact element connected with the conveying body during lateral pendulum movement of the cableway vehicle, and a contact element on the conveying body.

7. The cableway according to claim 6, further comprising:

a guide rail in the cableway station;

a cable clamp configured to couple the cableway vehicle with the hauling cable, at least one guide roller configured to allow the cableway vehicle to move along the guide rail when the cableway vehicle is decoupled from the hauling cable;

a support roller on the hanger carrier configured for pendulum movement in at least a vertical direction, and wherein the limiting device is configured in the cableway station to allow the support roller to deflect the movable detection element.

8. The cableway according to claim 7, wherein the limiting device comprises a guide profile tapering in a direction of movement of the hauling cable, wherein at least a portion of the guide profile comprises the movable detection element, wherein the guide profile further comprises two vertically opposite legs connected by a connecting portion and configured to receive the support roller between the two vertically opposite legs as the cableway vehicle approaches the cableway station.

9. The cableway according to claim 1, further comprising at least one of:

a spring device configured to cushion deflection of the movable detection element, wherein the spring device comprises at least one of a coil spring, a turning spring, a torsion spring, a leaf spring, a gas spring, an air spring, and a rubber spring, and a damping device configured to dampen deflection of the movable detection element, wherein the damping device comprises at least one of a hydraulic damper, a pneumatic damper, and a friction damper.

10. The cableway according to claim 2, further comprising a drive device that exerts a driving force on the hauling cable, and wherein the control unit is configured to control the drive device as a function of at least one of the detected measured variable, a variable derived from the detected measured variable, the determined lateral pendulum movement parameter, and a variable derived from the determined lateral pendulum movement parameter, wherein a first threshold value is defined and the control unit is further configured to stop the drive device or reduce a conveying speed of the cableway vehicle when at least one of the detected measured variable, the variable derived from the detected measured variable, the determined lateral pendulum movement parameter, and the variable derived from the determined lateral pendulum movement parameter exceeds the first threshold value.

11. The cableway according to claim 2, further comprising an alarm device, and wherein the control unit is configured to control the alarm unit as a function of at least one of the detected measured variable, a variable derived from the detected measured variable, the determined lateral pendulum movement parameter, and a variable derived from the determined lateral pendulum movement parameter, and cause the alarm device to generate an alarm signal, wherein a second threshold value is defined and the alarm unit is configured to generate the alarm signal when at least one of the detected measured variable, the variable derived from the detected measured variable, the determined lateral pendulum movement parameter, and the variable derived from the determined lateral pendulum movement parameter exceeds the second threshold value.

12. The cableway according to claim 1, wherein the detection unit comprises at least one of a distance sensor, a position sensor, a speed sensor, an acceleration sensor, a rotational angle sensor, a rotational speed sensor, a rotational acceleration sensor, a structure-borne noise sensor, a force sensor, a strain gauge, a pressure sensor, and an electrical switch.

13. A method for operating a cableway having at least one cableway station and having at least one cableway vehicle movable between cableway stations with a hauling cable, wherein the cableway is controlled with a control unit comprising the steps of:

providing a limiting device operable to limit lateral pendulum movement of the cableway vehicle as the cableway vehicle enters the cableway station, wherein the limiting device comprises at least one moveable detection element located adjacent to an entry region of the cableway station;

detecting a measured variable of deflection of the movable detection element when the cableway vehicle enters the cableway station with lateral pendulum movement and contacts the movable detection element; and controlling the cableway at least as a function of the detected measured variable.

14. The method according to claim 13, further comprising the steps of:

determining a lateral pendulum movement parameter of the entering cableway vehicle from at least one of the detected measured variable, a variable derived from the detected measured variable, and at least one operating variable of the cableway; and controlling the cableway at least as a function of the determined lateral pendulum movement parameter, wherein the determined lateral pendulum movement parameter comprises at least one of distance, position, speed, acceleration, angle, frequency, and wherein the operating variable of the cableway comprises a conveying speed.

15. The method according to claim 13, wherein the cableway vehicle comprises a conveying body and a hanger having a lower portion connected with the conveying body, an upper portion connected with the lower portion, and a hanger carrier connected with the upper portion, and wherein the step of detecting the measured variable further comprises deflection of the movable detection element with at least one of the conveying body, a component of the hanger, and a contact element on the conveying body.

16. The method according to claim 15, wherein the cableway comprises a guide rail in the cableway station; a cable clamp configured to couple the cableway vehicle with the hauling cable; at least one guide roller configured to allow the cableway vehicle to move along the guide rail when the cableway vehicle is decoupled from the hauling cable; a support roller on the hanger carrier; and wherein the limiting device comprises two mutually opposite limiting elements that converge in a direction of movement of the hauling cable and wherein at least one of the two mutually opposite limiting elements comprises the at least one movable detection element, the two mutually opposite limiting elements configured to receive the support roller between the two mutually opposite limiting elements; and wherein the step of detecting the measured variable further comprises detecting vertical pendulum movement of the cableway vehicle from resulting deflection of the at least one movable detection element in a vertical direction.

17. The method according to claim 16, wherein the limiting device comprises a guide profile tapering in a direction of movement of the hauling cable, wherein at least a portion of the guide profile comprises the movable detection element, wherein the guide profile further comprises two vertically opposite legs connected by a connecting portion and configured to receive the support roller between the two vertically opposite legs as the cableway vehicle approaches the cableway station; and wherein the step of detecting the measured variable further comprises detecting vertical pendulum movement of the support roller from resulting deflection of the guide profile in a vertical direction.

18. The method according to claim 13, further comprising the steps of:

determining at least one of a variable derived from the measured variable, a determined lateral pendulum movement parameter, and a variable derived from the determined lateral pendulum movement parameter;

defining a first threshold value of at least one of the measured variable, the variable derived from the measured variable, the determined lateral pendulum movement parameter, and the variable derived from the determined lateral pendulum movement parameter; and wherein the step of controlling the cableway further comprises:

controlling a conveying speed of the cableway vehicle as a function of at least one of the measured variable, the variable derived from the measured variable, the determined lateral pendulum movement parameter, and the variable derived from the determined lateral pendulum movement parameter; and reducing the conveying speed of or stopping the cableway vehicle when at least one of the measured variable, the variable derived from the measured variable, the determined lateral pendulum movement parameter, and the variable derived from the determined lateral pendulum movement parameter exceeds the first threshold value.

19. The method according to claim 13, wherein the cableway comprises an alarm unit; and further comprising the steps of:

determining at least one of a variable derived from the measured variable, a determined lateral pendulum movement parameter, and a variable derived from the determined lateral pendulum movement parameter;

defining a second threshold value of at least one of the measured variable, the variable derived from the measured variable, the determined lateral pendulum movement parameter, and the variable derived from the determined lateral pendulum movement parameter;

generating an alarm signal comprising at least one of an optical, an acoustic, and an electronic alarm signal when at least one of the measured variable, the variable derived from the measured variable, the determined lateral pendulum movement parameter, and the variable derived from the determined lateral pendulum movement parameter exceeds the second threshold value.

20. The method according to claim 13, wherein the step of detecting the measured variable further comprises detecting at least one of distance, position, speed, acceleration, rotational angle, rotational speed, rotational acceleration, structure-borne noise, force, pressure, tension, expansion, and end position.

* * * * *